United States Patent [19]

Truslaske

[11] Patent Number: 4,844,449

[45] Date of Patent: Jul. 4, 1989

[54] INFINITELY ADJUSTABLE ELEVATING SYSTEM FOR TREADMILL

[75] Inventor: James A. Truslaske, St. Louis, Mo.

[73] Assignee: True & True, St. Louis, Mo.

[21] Appl. No.: 57,043

[22] Filed: Jun. 3, 1987

[51] Int. Cl.[4] ..... A63B 23/06

[52] U.S. Cl. ..... 272/69

[58] Field of Search ..... 248/422, 398, 188.2, 248/653, 371, 393; 272/69, 134, 144, DIG. 4, 118; 254/95, 96, 97; 74/89.17, 422

[56] References Cited

U.S. PATENT DOCUMENTS

| | | | |
|---|---|---|---|
| 1,870,244 | 8/1932 | Elston | 254/95 |
| 2,115,632 | 4/1938 | Hanley | 74/89.17 |
| 2,233,055 | 2/1941 | Kennedy | 254/97 |
| 4,286,649 | 9/1981 | Rokop et al. | 254/97 X |
| 4,426,075 | 1/1984 | Otte | 272/DIG. 4 X |
| 4,601,466 | 7/1986 | Lais | 272/118 |

OTHER PUBLICATIONS

Quinton Instrument; 272/69; 1974; pp. 1, 2, 7, 27 and 31.

*Primary Examiner*—Richard J. Apley

*Assistant Examiner*—Howard Flaxman

*Attorney, Agent, or Firm*—Polster, Polster and Lucchesi

[57] ABSTRACT

An infinitely adjustable elevation system for a treadmill is disclosed. The treadmill has a frame having a pair of spaced side rails and a pair of spaced uprights extending upwardly from the front ends of the side rails. The elevation system comprises a pair of generally vertical, rigid, elongate members, each of which is carried by a respective side rail and which is movably mounted within a respective upright. Each of the elongate members is movable in a generally axial, vertical direction relative to its side rail between a retracted position in which the jogging surface of the treadmill is in substantially horizontal position, and an extended position in which the front of the treadmill (and the jogging surface) is inclined upwardly. The elevating system comprises a single power operated drive for positively moving both of the elongate members simultaneously in either axial direction between their stated retracted and extended positions and for positively holding them in any desired position with the elongate members supporting the front of the treadmill.

14 Claims, 3 Drawing Sheets

FIG. 8.
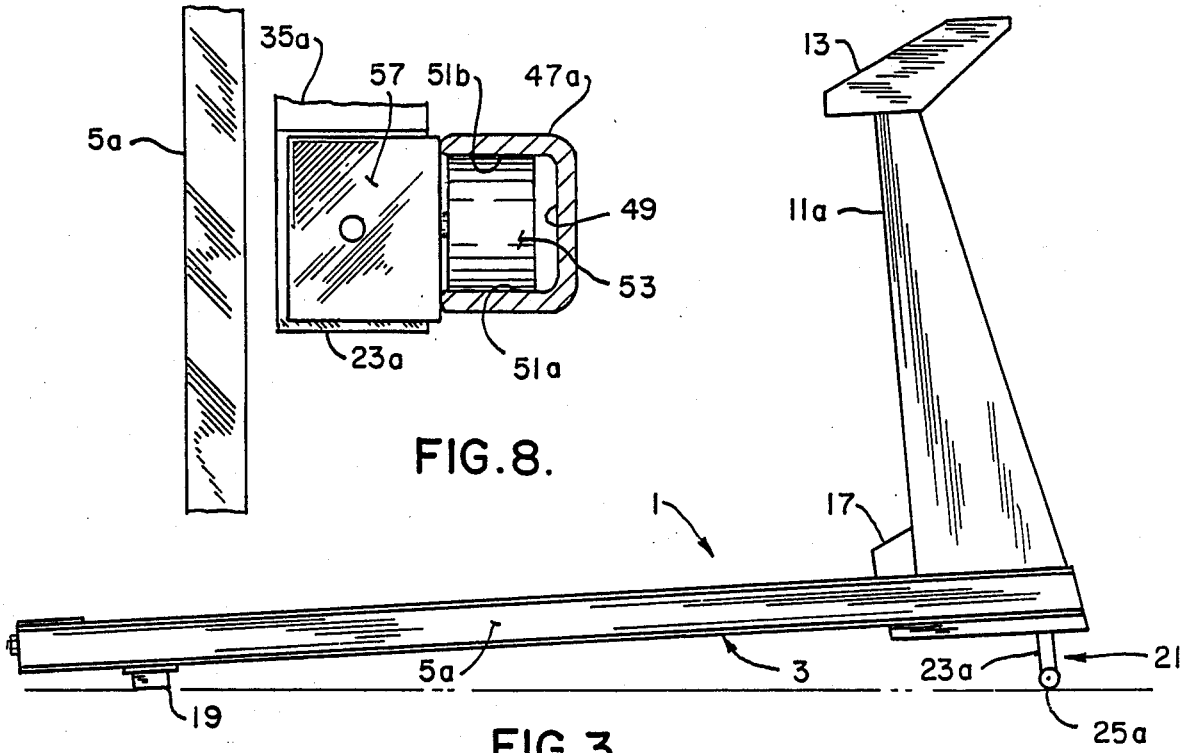
FIG. 3.
FIG. 5.
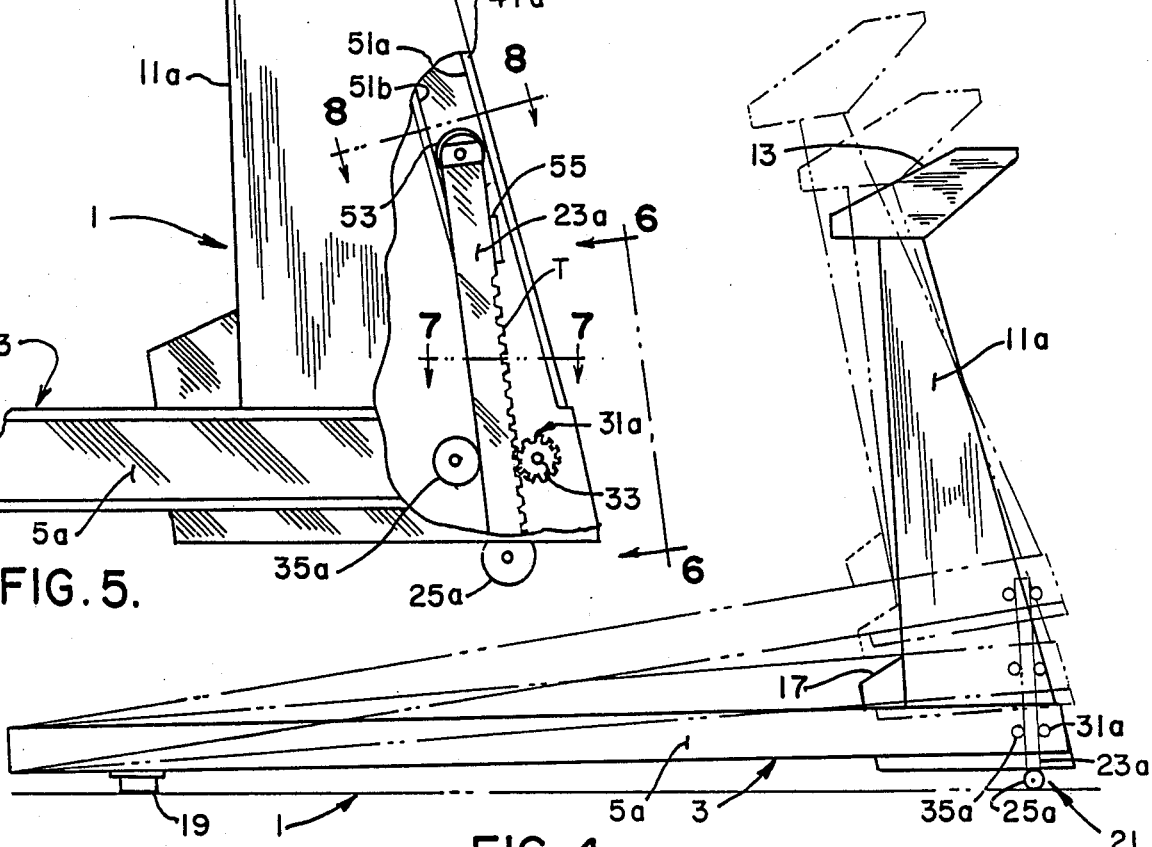
FIG. 4.

INFINITELY ADJUSTABLE ELEVATING SYSTEM FOR TREADMILL

BACKGROUND OF THE INVENTION

This invention relates to an infinitely adjustable elevating system for a treadmill.

Generally, exercising treadmills have come into widespread use for walking or running "in place" indoors to maintain a program of physical fitness or, in a medical testing facility, to permit patients undergoing a stress electrocardiogram test to exercise vigorously while electrocardographic and other data is acquired. Generally, exercise treadmills include a frame extending lengthwise of the treadmill having a pair of spaced apart side rails with a front and rear horizontal roller interposed therebetween and journaled with respect to the side rails. An endless treadmill belt is entrained around the rollers and the upper reach of the belt is supported by a bed or the like so as to constitute a walking or jogging surface which will support a user of the treadmill while walking or running thereon. The treadmill belt is driven by an electric motor or the like such that the upper reach of the belt moves from front to rear over the bed, thus necessitating a user of the treadmill to walk or run in forward direction on the moving belt so as to remain stationary with respect to the frame of the treadmill. Typically, the speed of the treadmill belt can be varied.

For a general description of such treadmills, reference may be made to our U.S. Pat. No. 4,616,822, issued Oct. 14, 1986, which is herein incorporated by reference.

In addition to increasing or decreasing the speed of the belt to vary the amount of physical exertion expended by a user of the treadmill, it is oftentimes typical for the treadmill to have an elevation system which selectively raises the front of the treadmill relative to the rear of the treadmill, thus inclining the jogging or walking surface such that a person walking or jogging on the upper reach of the treadmill belt will, in essence, be required to walk or run uphill, thus expending additional energy.

In U.S. Pat. No. 3,643,943, a treadmill elevating system is disclosed in which a gearmotor drives a single upright screw so as to raise and lower the front of the treadmill relative to the back of the treadmill. However, this elevating system requires a floor engaging base for mounting the electric motor, and a treadmill frame which is pivotally connected to the rear of the floor engaging base. Additionally, since only one gearmotor and screw is provided, the treadmill frame, when elevated, may not have a degree of stability which is desirable when an adult walks or jogs on the treadmill surface.

U.S. pat. No. 3,731,917 discloses a treadmill in which a pair of removable legs is provided at the front of the treadmill, with these legs being interchangeable with legs of different lengths so as to change the elevation of the treadmill.

U.S. Pat. No. 3,826,491 discloses a treadmill in which the frame of the treadmill, intermediate its ends, is pivotally mounted on a floor engaging base and in which a fluid operated cylinder at one end of the frame effects pivoting movement of the frame relative to the base so as to change the elevation of the treadmill.

U.S. Pat. No. 4,344,616 discloses the provision of a hand-operated screw jack at each side of the front of the treadmill frame which may be manually rotated in one direction or the other to change the elevation of the treadmill.

U.S. design pat. No. 270,555 also discloses an exercise treadmill having screw jacks at each side of the front of the frame, with the screw jacks being rotatable to vary the elevation of the treadmill.

U.S. design pat. No. 273,029 discloses an elevating system for a treadmill, in which legs at the front of the treadmill frame are pivotally mounted with respect to the treadmill frame may be rotatably, pivotally raised and lowered so as to change the elevation of the treadmill.

SUMMARY OF THE INVENTION

Among the several objects and features of the present invention may be noted the provision of an infinitely adjustable elevation system for a treadmill which is power operable and which is compact in size so as to enable it to fit within the structure of a treadmill without the requirement of additional covers or an excessively bulky appearance and permitting a "trimline" design;

The provision of such a treadmill elevation system which positively raises or lowers each side of the treadmill in unison;

The provision of such an elevating system which solidly supports the treadmill and the weight of a user thereon without rocking or tipping in any desired position between its retracted horizontal position and its fully raised, elevated position;

The provision of such an elevation system which minimizes vibration within the treadmill during operation of the treadmill and jogging (or walking) thereon;

The provision of such an elevation system in which the stability of the treadmill is maximized in its lowered, horizontal position, in any intermediate position, or in its fully elevated position;

The provision of such an elevation system in which the ends of the elevating members engaging the floor do not require substantial fore and aft movement of either the elevating members or of the treadmill relative to the floor as the treadmill is raised and lowered;

The provision of such an elevation system which ensures that the side rails of the treadmill frame remain parallel to one another as the treadmill is elevated and retracted without rocking or twisting, even if the weight of a user is supported substantially only on one side of the treadmill, thus ensuring that the belt runs true on the rollers; and The provision of such a treadmill elevation system which is of simple and rugged construction, which is easy to install and maintain, which has a long service life, which is economical to manufacture, and which is easy to use.

Other objects and features of this invention will be in part apparent and in part pointed out hereinafter.

Briefly stated, an infinitely adjustable elevation system for a treadmill is disclosed. The treadmill comprises an elongate frame having a pair of spaced side rails extending from front to rear of the treadmill. A front roller and rear roller are journaled between the side rails, and an endless belt is entrained around the rollers, with the upper surface of the belt constituting a jogging or walking surface for supporting a user of the treadmill thereon. The frame has a pair of spaced uprights at the front thereof each extending upwardly from a respective side rail. The elevation system comprises a pair of generally vertical, rigid, elongate members, each of which is carried by a respective side rail at the front thereof, and each of which is movably mounted within a respective upright. Each elongate member is movable in generally axial, vertical direction relative to its respective side rail between a retracted position in which the jogging surface is substantially horizontal, and an extended position in which the front of the jogging surface is inclined upwardly. The elevating system comprises a single power-operated means for positively and simultaneously moving both of the elongate members in either axial direction between their retracted and extended positions, and for positively holding the elongate members in any desired position between their extended and retracted positions, with the elongate member supporting the front of the treadmill.

BRIEF DESCRIPTION OF THE DRAWINGS

FIG. 3 is a view similar to FIG. 2, showing the treadmill in its fully extended or raised elevated position;

FIG. 4 is a view similar to FIG. 2, showing the treadmill in its lowered horizontal position, and (in phantom) in an intermediate elevated position, and in its fully elevated position in which the inclination of the treadmill is inclined at a slope of about 15 degrees;

FIG. 5 is an enlarged view of the front portion of the treadmill, taken along line 5—5 of FIG. 2, with parts of the upright and side rails broken away so as to illustrate an elongate, substantially vertical member which is positively driven in generally axial, vertical direction relative to the treadmill frame between a retracted position (as shown in FIGS. 1, 2, and 5) in which the treadmill is in a horizontal position, and an extended position (as shown in FIGS. 3, 4, and 6) in which the elongate members on both sides of the treadmill extend down below their retracted positions and thus raise the front of the treadmill above the horizontal to a desired inclined positions, as shown in FIGS. 3 and 4;

FIG. 8 is a plan view, taken along line 8—8 of FIG. 5, illustrating the details of the elevating system at the top thereof.

Corresponding reference characters indicate corresponding parts throughout the several views of the drawings.

DESCRIPTION OF A PREFERRED EMBODIMENT

Figure 1:
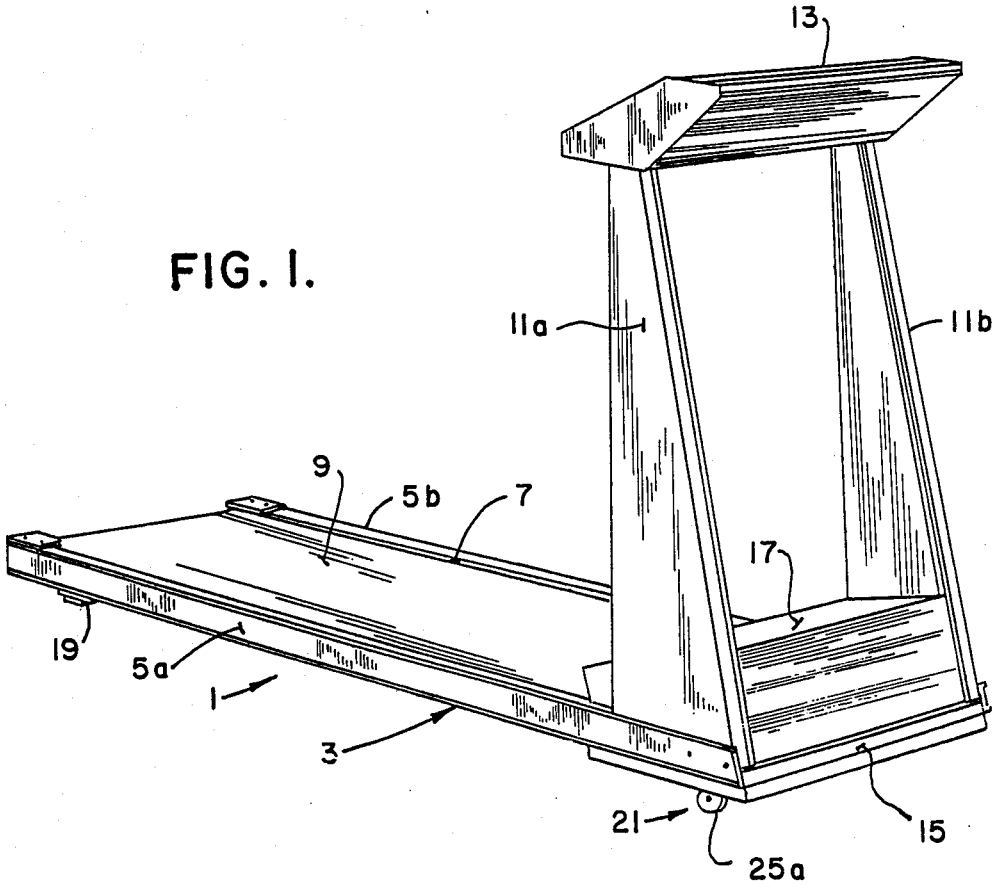
FIG. 1 is a front perspective view of a treadmill of the present invention incorporating an infinitely adjustable elevation system of the present invention.

Referring now to the drawings, an exercise treadmill is indicated in its entirety by reference character 1. The treadmill is shown to comprise a frame, as generally indicated at 3, having a pair of generally horizontally disposed, spaced apart side rails 5*a*, 5*b*. A bed 7 supported by rails 5*a* and 5*b* is disposed between the rails. An endless belt, as generally indicated at 9, is entrained around a front and a rear roller (not shown) interposed between and journaled with respect to side rails 5*a* and 5*b*, with the upper reach of the belt overlying bed 7 such that the upper reach of the belt slides on the bed and is supported by the bed. In this manner, a user of treadmill 1 may walk or jog on the upper surface of the belt supported by the bed. Frame 3 further comprises a pair of spaced uprights 11*a*, 11*b* extending generally upwardly from a respective side rail 5*a*, 5*b* at the forward or front end of the frame. A control panel 13 extends transversely between the upper ends of the uprights and a front frame 15 spans between the front ends of side rails 5*a*, 5*b*. A cover 17 is provided between the lower ends of the upright and encloses the front roller and the drive mechanism for the treadmill belts. Rear foot pads 19 are provided on side rails 5*a*, 5*b* for supporting the rear ends of the treadmill.

As thus far described, treadmill 1 is substantially conventional, and the construction of the treadmill, per se, does not constitute a part of the instant invention. The treadmill has been described to provide the environment for the instant invention which will be hereinafter described in detail. However, for a more detailed disclosure of the construction of treadmill 1, reference may be made to our prior U.S. Pat. No. 4,616,822, issued Oct. 14, 1986, which is herein incorporated by reference.

Figure 2:
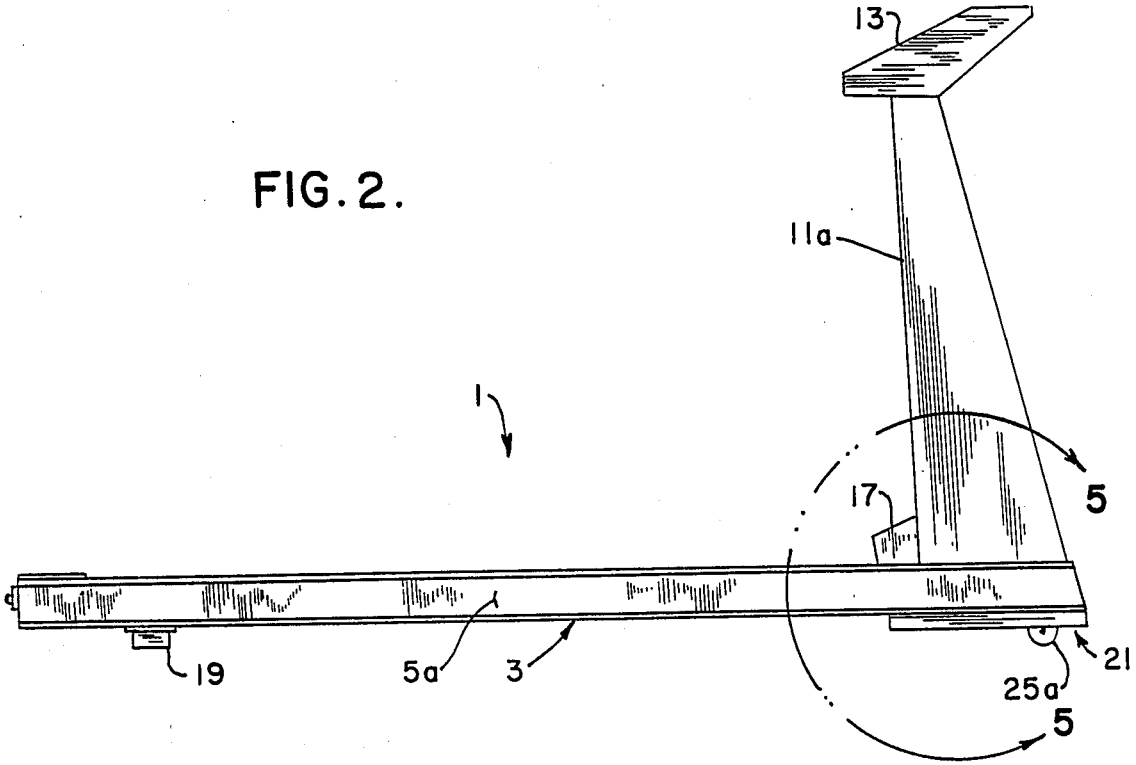
FIG. 2 is a right side elevational view of the treadmill.
Figure 6:
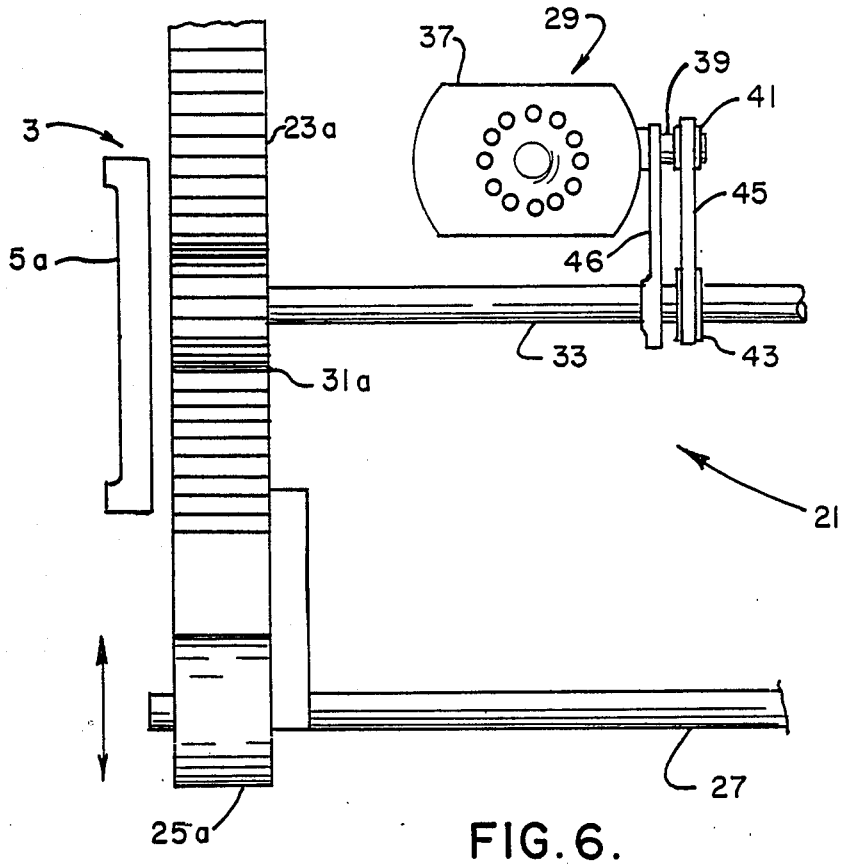
FIG. 6 is a front side elevational view of a portion of the elevating system, taken along line 6—6 of FIG. 5, on a somewhat enlarged scale.
Figure 7:
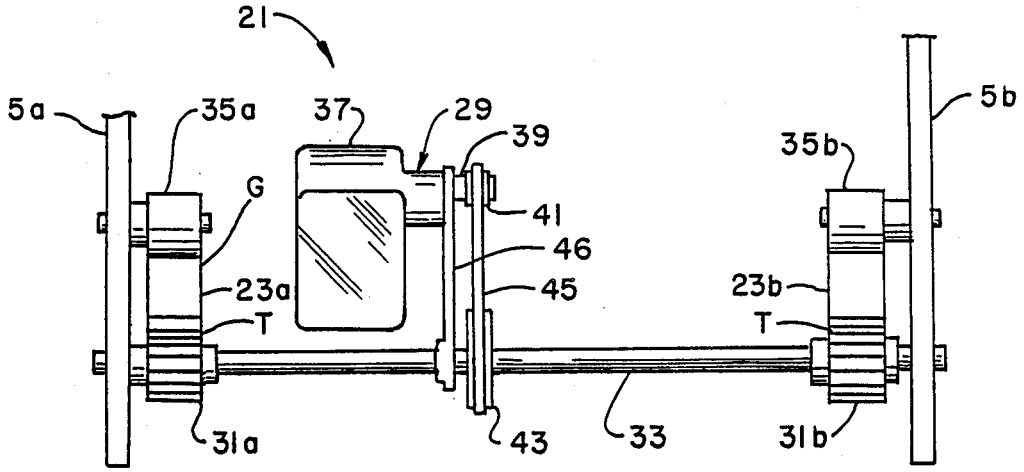
FIG. 7 is a cross sectional view, taken along line 7—7 of FIG. 5, of the elevation system.

As indicated generally at 21, an infinitely adjustable elevation system for a treadmill is provided. This treadmill elevation system includes a pair of spaced apart, generally vertically extending members, as indicated at 23*a*, 23*b*, carried by respective side rails 5*a*, 5*b*. Members 23*a*, 23*b* are generally axially, vertically extendable and retractable from a retracted position (as shown in FIGS. 1, 2, and 5) in which the bed 7 and upper reach of belt 9 of treadmill 1 are substantially horizontal, and a raised or elevated position, as shown in FIGS. 3 and 4, in which the forward end of bed 7 inclines upwardly at an elevation angle E (see FIGS. 3 and 4) such that the surface on which a user of the treadmill walks or jogs inclines upwardly or uphill. Respective rollers 25*a*, 25*b* are carried on the lower ends of the generally vertically extensible and retractable members 23*a*, 23*b* such that the treadmill 1, together with the weight of a user supported thereon, rests solely on wheels 25*a*, 25*b* at the front of the treadmill, and on rear feet pads 19 at the rear of the treadmill, whether the treadmill is in its horizontal or elevated position. A stabilizing bar 27 (as shown in FIG. 6) extends between the lower ends of the generally vertically disposed members or gear racks 23*a*, 23*b* generally at the level of wheels 25*a*, 25*b*.

Further in accordance with this invention, elevation system 21 includes a single, selectively operable, power operated means 29 for infinitely extending and retracting the generally vertically extending members 23*a*, 23*b* relative to treadmill frame 3 for infinitely adjusting the elevation of the treadmill between its horizontal position and its maximum elevated position. More specifically, each of the vertically disposed members 23*a*, 23*b* is carried by the front portion of a respective side rail 5*a*, 5*b* at the front of the side rail and is at least in part movably mounted within a respective upright 11*a*, 11*b* as it moves between its extended and retracted positions. More specifically, the single power operated means 29 for extending and retracting elongate vertical members 23*a*, 23*b* positively moves both of the elongate members 23*a* and 23*b* simultaneously in either axial direction between their extended and retracted positions and positively holds the elongate members 23*a*, 23*b* in any desired axial position between their extended and retracted positions, with the elongate members and the wheels 25a, 25b mounted thereon supporting the front portion of the treadmill.

Each of the elongate members 23a, 23b has a front face and a rear face. As previously noted, the elongate members are positively driven between their retracted position and extended position by power operated means 29 which includes a pair of rotary drive member, as generally indicated at 31a, 31b, engageable with one face (i.e., the front face) of a respective elongate member 23a, 23b. As shown, these rotary drive members 31a, 31b are constituted by respective pinions and the respective elongate members 23a, 23b are, in this particular embodiment, constituted by gear racks having a plurality of teeth T thereon in mesh with pinions 31a, 31b. The pinions 31a, 31b are affixed to and are rotatable with a common pinion shaft 33 journaled between and extending transversely between side rails 5a, 5b at the front of frame 3. On the back side of racks 23a, 23b, generally at the level of pinions 31a, 31b, a respective elastomeric pinion roller 35a, 35b is journaled with respect to its respective side rail member 5a, 5b so as to be in firm, resilient engagement with the back face of the rack thereby to positively hold the teeth T of racks 23a, 23b in mesh with the teeth of respective pinions 31a, 31b.

As shown herein, the power operated means 29 is shown to comprise a right angle gearmotor 37 rigidly supported on frame 3. The gearmotor has an output shaft 39 on which a drive sprocket 41 is affixed. A driven sprocket 43 is affixed to pinion shaft 33 and an endless chain 45 is entrained around the drive sprocket and the driven sprocket so as to constitute a chain and sprocket drive interconnecting the output shaft of gearmotor 37 to pinion shaft 33. A bracket 46 is journaled o output shaft 39 of the gearmotor and is also journaled on pinion shaft 33 thereby to positively maintain the spacing between output shaft 39 and pinion shaft 33. This, in turn, tends to facilitate the elimination of slack in chain 45.

In accordance with this invention, gearmotor 37 is irreversible, meaning that its mechanical advantage is such that it cannot be back-driven by applying torque to output shaft 39 via the weight of the treadmill with a runner thereon inducing a torque in pinion shaft 33 due to the fact that pinions 31a, 31b are in mesh with elongate members or racks 23a, 23b. In this manner, when gearmotor 37 is de-energized, the racks are positively held or locked in position by their respective pinions 31a, 31b in mesh therewith, and the elevation system 21 of the present invention is infinitely adjustable between its horizontal and maximum raised or elevated position.

Uprights 11a, 11b each include a respective generally vertically disposed channel member 47a, 47b inboard of racks 23a, 23b. Channels 47a, 47b each include a web 49 with front and rear flanges 51a, 51b. The distance between front and rear flanges 51a, 51b of each channel 47a, 47b is sufficient so as to accommodate a roller 53 (see FIG. 5) carried on the upper end of each of the racks 23a, 23b, with roller 53 being rollingly engageable with the rearwardly facing surface of front flange 51a of its respective channel 47a, 47b. Thus, the roller 53 cooperates with the rearwardly facing surface of the front flange 53a of its respective channel such that the flange of the channel serves as a guide surface guiding the upper end of the elongate vertical racks 23a, 23b for maintaining the racks in substantial upright position as the racks are vertically, axially driven between their retracted and extended positions by pinions 31a, 31b and mesh with the teeth T of the racks. At a selected location along the upper end of racks 23a, 23b, a stop 55 is selectively affixed to the front face of the rack overlying the teeth T of the rack so as to engage the pinions 31a, 31b and thereby to prevent overextension of the elevating system, thus allowing the pinions to "walk off" the upper ends of the racks. Further, a wiper 57, of a suitable thermoplastic, low friction material, is secured to the upper ends of each of the racks 23a, 23b to be in frictional rubbing relation with channels 49a, 49b thereby to eliminate play between the racks and the channels and to resiliently eliminate or minimize rattling or other vibration between the racks and the channels.

In operation, with the elevation system 21 of the present invention in its retracted position, and with frame 3 in generally horizontal position, as shown in FIGS. 1 and 2, the generally vertically disposed elongate racks 23a, 23b are retracted relative to their respective side rails 5a and 5b and are disposed in generally upright position within their respective uprights 11a, 11b. A suitable control switch (not shown) may be provided on control panel 13 readily accessible by a runner or jogger supported on the upper reach of the treadmill belt 9. Upon energization of gearmotor 37 in one direction, so as to effect raising of the front of treadmill 1, the gearmotor affects rotation of pinion shaft 33 in one direction (i.e., in counterclockwise direction, as shown in FIG. 5) so as to positively and simultaneously feed the gear racks 23a and 23b downwardly relative to their respective side rails 5a and 5b an equal distance. As the racks 23a, 23b are forcebly extended, side rails 5a, 5b tend to rotate on their back pads 19 such that the front of the treadmill is raised or elevated, in the manner shown in FIGS. 3 and 4 toward a fully elevated position, as shown in FIG. 4, in which the slope or incline of the treadmill bed 7 is at about a 15 percent grade.

At any desired elevation position between the horizontal position and the maximum elevation position, the treadmill elevating system 21 may be stopped by de-energizing gearmotor 37. Upon de-energization of the gearmotor, the gearmotor, via the chain and sprocket drive, positively holds pinions 31a, 31b and racks 23a, 23b in their desired extended or retracted positions relative to side rails 5a, 5b.

It will be particularly noted that the elevation system 21 of this invention is compact and can be readily accommodated within the relatively narrow side rails 5a and 5b and uprights 11a, 11b, as illustrated in FIG. 1. Further, it will be seen, particularly as illustrated in FIG. 6, that the vertically extending racks 23a, 23b are disposed in relatively close proximity inboard of side rails 5a, 5b such that the wheels 25 supporting the front end of the treadmill are as far outboard as possible thereby to maximize the lateral or side-to-side stability of the treadmill as it is supported by the elevating system. Further, because of the positioning of resilient rollers 35a, 35b on the back side of racks 23a, 23b opposite pinions 31a, 31b, the racks are firmly resiliently biased into mesh with the pinions. Also, it will be appreciated that as the racks 23a, 23b are extended toward their fully extended position such that the treadmill is in its fully raised or elevated position, the rollers 53a journaled on the tops thereof and in engagement with the guide surface 51a of channels 47a, 47b tend to transfer a substantial portion of the weight of the treadmill and the user supported on the treadmill to the channel, thus rigidizing the elevating system and helping to make the treadmill substantially free of vibration during operation or use by a person exercising thereon. Still further, with racks 23a, 23b nearly vertical, rollers or wheels 25a, 25b remain substantially stationary with respect to the floor as the treadmill is elevated or lowered.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. An infinitely adjustable elevation system for a treadmill, the latter comprising an elongate frame having a pair of spaced side rails extending from front to rear, a front and a rear horizontal roller interposed between said side rails, and an endless belt entrained around said rollers with the upper surface of the belt constituting a jogging or walking surface for supporting a user of the treadmill, the frame having fixed supporting foot pads at the rear thereof and having a pair of spaced uprights at the front thereof extending generally upwardly from said side rails, said elevation system comprising a pair of generally vertical rigid elongate members, each of which is carried by a respective side rail at the front thereof and is movably mounted within a respective upright, said elongate members each being movable in generally axial, vertical direction relative to therein respective said side rails between a retracted position in which said jogging surface of said treadmill is substantially horizontal, and an extended position in which the front of the jogging surface is inclined upwardly, said elevating system further comprising a guide surface disposed within each of said uprights which extends at an angle to said generally vertical rigid elongate members, a roller carried on the upper end of each of said elongate members and engageable with a respective angularly extending guide surface for maintaining said elongate members in substantially vertical position as said elongated members are driven between retracted and extended positions, and positive drive means for moving said elongate members between retracted and extended positions and including guide elements for engaging said elongate members at a distance spaced from each roller and cooperating guide surface, for assisting in maintaining said elongate members in substantially vertical position.

2. An elevation system as set forth in claim 1 wherein said elongate members each have a front face and rear face, each of said elongate members being positively driven between their said retracted and extended positions by a rotary drive, member engageable with one of said faces thereof, each of said guide elements comprising a roller carried by said frame opposite said drive member and forceably engaging the other face of said elongate member thereby to at least in part maintain said elongate member in positive driven direction with said rotary drive member.

3. An elevation system as set forth in claim 2 wherein said elevating system further comprises a single power operated means for positively moving both of said elongate members simultaneously in either generally vertical, axial direction between their said retracted and extended positions and for positively holding said elongate members in any desired position between their said extended and retracted position with said elongate members supporting the front of said treadmill.

4. An elevation system as set forth in claim 2 wherein said elongate member has a gear rack on said front face thereof, and wherein said rotary drive member is a pinion in positive mesh with said rack.

5. An elevation system as set forth in claim 4 wherein said power operated means for simultaneously driving said elongated members comprises a common shaft journaled with respect to said frame and having a pinion for each of said elongated members at opposite sides of said treadmill affixed to said shaft, with said pinions being in mesh with a respective said elongated members, and a selectively operable single drive unit for rotating said common shaft in one direction or the other for extending and retracting said elongated members.

6. An elevation system as set forth in claim 5 wherein said drive has a gearmotor coupled to said common shaft, said gearmotor being irreversible such that it cannot be back-driven, said gearmotor thus positively holding fixed said racks at any position between said retracted and extended positions upon de-energization of said gearmotor.

7. An elevation system as set forth in claim 6 wherein said gearmotor has an output shaft axially offset from said common shaft, said output shaft being coupled to said common shaft.

8. An elevation system as set forth in claim 6 further comprising a chain and sprocket drive for interconnecting said gearmotor output shaft and said common shaft.

9. An elevation system as set forth in claim 4 wherein said roller engageable with said other face of said rack is an elastomeric roller which is at least partially compressed by said rack such that said elastic roller resiliently maintains said rack in mesh with said pinion.

10. An elevation system as set forth in claim 1 wherein each of said uprights has a generally upwardly extending channel therewithin, said channel having a flange thereon with said flange constituting said guide surface.

11. An elevation system as set forth in claim 10 wherein said elongated member carries a wiper slidingly engageable with said channel as said elongated member is extended and retracted thereby to reduce play between said elongated member and said channel.

12. An elevation system as set forth in claim 1 wherein said each of said elongate members carries a wheel on its lower end engageable with the floor, with said wheels carried by said racks supporting the weight of the treadmill at the front thereof.

13. An elevation system as set forth in claim 12 wherein said frame has a pair of feet at the rear thereof such that the treadmill is supported on the floor only by said rear feet and by said wheels at the front of the treadmill.

14. An infinitely adjustable elevation system for a treadmill, the latter comprising an elongate frame having a pair of spaced side rails extending from front to back, a front and a rear roller interposed between said side rails and an endless belt entrained around said rollers with the upper surface of the belt constituting a jogging or walking surface for supporting a user of the treadmill, said frame having fixed supporting foot pads at the rear thereof and having a pair of spaced uprights at the front extending upwardly from said side rails, said elevation system comprising a pair of generally vertically disposed elongate rigid racks, each of which is carried by a respective said side rail at the front thereof, and each of which is disposed at least in part and is movable in generally axial vertical direction within said uprights between a retracted position in which said jogging surface of said treadmill is substantially horizontal, and an extended position in which the front of said jogging surface is inclined upwardly, said elevating system further comprising a single gearmotor for positively driving each of said elongate members simultaneously in either generally vertical, axial direction between said retracted and said extended positions, each of said racks having a pinion in mesh therewith on the front face thereof, said pinions being rigidly mounted to and interconnected with a common pinion shaft extending transversely of the treadmill, a gearmotor supported by said frame, said gearmotor having an output shaft, said output shaft having a gear and sprocket drive thereon interconnecting said output shaft and said pinion shaft such that upon energization of said gearmotor, said gearmotor effects the simultaneous extension or retraction of said racks, said gearmotor being irreversible such that it cannot be back-driven so that upon de-energization of said gearmotor, said gearmotor positively holds said racks in fixed position with respect to said frame, an elastomeric roller rotatably mounted with respect to said frame in resilient engagement with the back face of a respective said rack for holding said racks in positive engagement with said pinions, each of said uprights having a channel therewithin extending at an angle to said racks, each of said racks carrying a roller engageable with a surface of said angularly extending channel for guiding the upper end of said racks as said racks are extended and retracted by said gearmotor, and said pinions and elastomeric rollers being spaced from said roller carried by each rack and cooperating therewith for maintaining said racks in substantially vertically position as said racks are moved between retracted and extended positions.

* * * * *